US007429307B2

(12) United States Patent
Söderberg

(10) Patent No.: US 7,429,307 B2
(45) Date of Patent: Sep. 30, 2008

(54) METHOD OF FORMING A FIBROUS WEB

(75) Inventor: Daniel Söderberg, Åkersberga (SE)

(73) Assignee: STFI, Skogsindustrins Tekniska Forskningsinstitut AB, Stockholm (SE)

( * ) Notice: Subject to any disclaimer, the term of this patent is extended or adjusted under 35 U.S.C. 154(b) by 499 days.

(21) Appl. No.: 10/497,419

(22) PCT Filed: Dec. 3, 2002

(86) PCT No.: PCT/SE02/02217

§ 371 (c)(1),
(2), (4) Date: Jun. 15, 2004

(87) PCT Pub. No.: WO03/048452

PCT Pub. Date: Jun. 12, 2003

(65) Prior Publication Data

US 2005/0034827 A1 Feb. 17, 2005

(30) Foreign Application Priority Data

Dec. 5, 2001 (SE) ..... 0104073

(51) Int. Cl.
*D21F 11/00* (2006.01)

(52) U.S. Cl. ..... 162/123; 162/343; 162/336; 162/125

(58) Field of Classification Search ..... 162/123, 162/343, 336
See application file for complete search history.

(56) References Cited

U.S. PATENT DOCUMENTS

| | | | | |
|---|---|---|---|---|
| 3,923,593 | A * | 12/1975 | Verseput | 162/301 |
| 4,376,014 | A * | 3/1983 | Bergstrom | 162/336 |
| 5,204,009 | A * | 4/1993 | Rowland | 210/772 |
| 6,471,828 | B1 * | 10/2002 | Ruf et al. | 162/343 |

FOREIGN PATENT DOCUMENTS

| | | |
|---|---|---|
| GB | 2107751 | 5/1983 |
| WO | WO 82/03413 | 10/1982 |

* cited by examiner

*Primary Examiner*—Mark Halpern
(74) *Attorney, Agent, or Firm*—Ware, Freesola, Van Der Sluys & Adolphson LLP

(57) ABSTRACT

In a method of forming a layered fibrous web, the method includes the steps of leading at least two different fiber suspensions through a head box (10), separating the fiber suspensions from each other by a blade device (18, 180), supplying the fiber suspensions to a web forming device (24) and forming a water layer having a transversely uniform flow at an outlet at the end of the blade device (18, 180), such that the water layer constitutes an extension of the blade device and thereby prevents mixing of the fiber suspensions. The blade device (18, 180) can be freely movable in a substantially vertical direction in order to permit an equalization of pressure between the fiber suspension layers separated by the blade device and thereby reducing wake effects downstream the edge of the blade device. A paper machine for carrying out the method is also disclosed.

10 Claims, 3 Drawing Sheets

METHOD OF FORMING A FIBROUS WEB

This application is a 371 of PCT/SE02/02217 filed on 3 Dec. 2002.

TECHNICAL FIELD

The present invention relates to a method of forming a layered fibrous web and a machine therefor.

DESCRIPTION OF THE BACKGROUND ART

In the paper industry, it is often desirable to form multi-layered fibrous pulp webs, where different fiber suspensions are used in the different layers. A paper can for example consist of a core made of recycled fiber material while the surface layers consist of a different fiber material in order to give the paper a desired surface. Such multi-layered webs can be produced by means of layered head boxes, where the different fiber suspensions are separated by means of at least one blade. At the outlet of the head box, the fiber suspension layers are dispensed on top of each other on a paper forming wire and thereby forming a multi-layered fibrous pulp web. Since the different layers often consist of materials with different fiber properties or even different colors, it is essential to prevent mixing of the layers. The mixing is mainly caused by the wake that is formed behind the trailing edge of the blade. These wakes generate strong turbulent mixing, which effectively prevents the possibility to obtain a good layer purity. Several attempts to solve this problem have been made.

The British patent application GB, A, 2107751 discloses a paper machine and a process for producing a multi-layer fibrous pulp web, where two layers of fiber suspension are separated by an intermediate flow duct through which water is flowing and thereby forming a separating layer between the fiber suspension layers. Said flow duct extends from the inlet end of the head box up to approximately the center of the head box and consists of rigid partition walls. This construction requires a symmetrical position of the blades in the head box in order to achieve equal pressure on both sides of the blade at the trailing edge. Also, severe mixing will take place unless the partition walls forming the flow duct are extremely accurately positioned, which in reality is practically impossible. As a consequence of this, it is not possible to feed different volume flows of fiber suspension separated by the partition walls without causing an unwanted difference in pressure between the fiber suspension layers. The positioning of the partition walls in order to achieve equal pressure on both sides of the blade must furthermore be adapted for one specific speed of the fiber suspension, which makes the paper machine inflexible to use.

SUMMARY OF THE INVENTION

The object of the invention is to solve the problems related to the prior art. This is achieved by means of a method according to claim 1. More specific, the present invention relates to a method of forming a layered fibrous web, comprising leading at least two different fiber suspensions through a head box, separating the fiber suspensions from each other by a blade device, supplying the fiber suspensions to a web forming device and forming a water layer having a transversely uniform flow at an outlet at the end of the blade device, such that the water layer constitutes an extension of the blade and thereby prevents mixing of the fiber suspensions. The method furthermore comprises arranging the blade device to be freely movable in a substantially vertical direction in order to permit an equalization of pressure between the fiber suspension layers separated by the blade device and thereby reducing wake effects downstream the edge of the blade device.

Furthermore, the invention relates to a paper machine including a head box comprising at least one fiber suspension separating blade device provided with a water outlet, the outlet being arranged so as to form a water layer which constitutes an extension of the blade device and having a transversely uniform flow rate. The blade device is arranged to be freely movable in a substantially vertical direction in order to permit an equalization of pressure between the fiber suspension layers separated by the blade device and thereby reducing wake effects downstream the edge of the blade device.

The blade device is hereby automatically adjusted to compensate for differences in pressure and consequently differences in speed of the different fiber suspension layers. It is therefore possible to feed different flow volumes of fiber suspensions in each layer in a multi-layered head box and keeping the speed of the useful e.g. when forming a layered paper web with layers having different thickness. It is also possible to position one or more blades asymmetrically in the head box.

According to one preferred embodiment of the invention, water is pumped through the blade device in internal channels in order to obtain a pressure drop, which will assure that the water flow rate is the same in all channels. The channels terminate preferably at a distance from the water outlet at the end of the blade device in order to provide a uniform flow rate of the water coming out from the blade device.

In another preferred embodiment of the invention, a pressure drop screen is arranged inside the blade device transversely to the direction of the intended water flow. The pressure drop screen can preferably be constituted of a porous material such as a net member arranged to span the entire width and height of a cross section of the blade device in order to provide a uniform water flow out from the blade device.

The height of the water outlet from the blade device, and thereby the height of the water layer is preferably kept constant, and the flow rate of the water is adjusted by changing the pumping pressure of the water. The water can be given a speed that is either higher or lower than the speed of the fiber suspension. At a water speed lower than the fiber suspension speed, a wake effect is still present downstream the end of the blade device. A water speed that is higher than the fiber suspension speed can on the other hand result in a jet effect, which leads to an increased mixing of the layers. By changing the flow rate of the water it is possible to control the layering of the different fiber suspensions in order to achieve an optimal state, where minimal mixing between the layers at minimal water consumption is achieved.

The water is supplied to the blade device preferably by means of a feed pipe, which is arranged at an upstream end of the blade device and perpendicular to the direction of the intended water flow.

Pressure equalization between the fiber suspension layers that are separated by the blade device can be achieved in different ways. In one embodiment of the invention, the blade device is movable in such a way that it is elastically deformable and thereby permitting the equalization of pressure between the fiber suspension layers.

In another preferred embodiment, the blade device is pivotally supported at an upstream end thereof and can pivot freely around a pivot axis perpendicular to the intended flow direction, thereby permitting equalization of pressure between the fiber suspension layers. The water feed pipe is preferably connected to the blade device in a rotationally fixed manner in such a way that the feed pipe coincides with the pivot axis of the blade.

The blade device can furthermore be both elastically flexible and pivotally supported.

The blade device can comprise a pair of parallel mutually spaced sheets, arranged above each other and substantially parallel to the direction of the intended water flow. Alternatively, the blade device can comprise a pair of sheets, which are arranged above each other and converge towards each other in the direction of the intended water flow, whereby the outlet from the blade device is narrower than the inlet.

DETAILED DESCRIPTION OF EMBODIMENTS OF THE INVENTION

Figure 1:
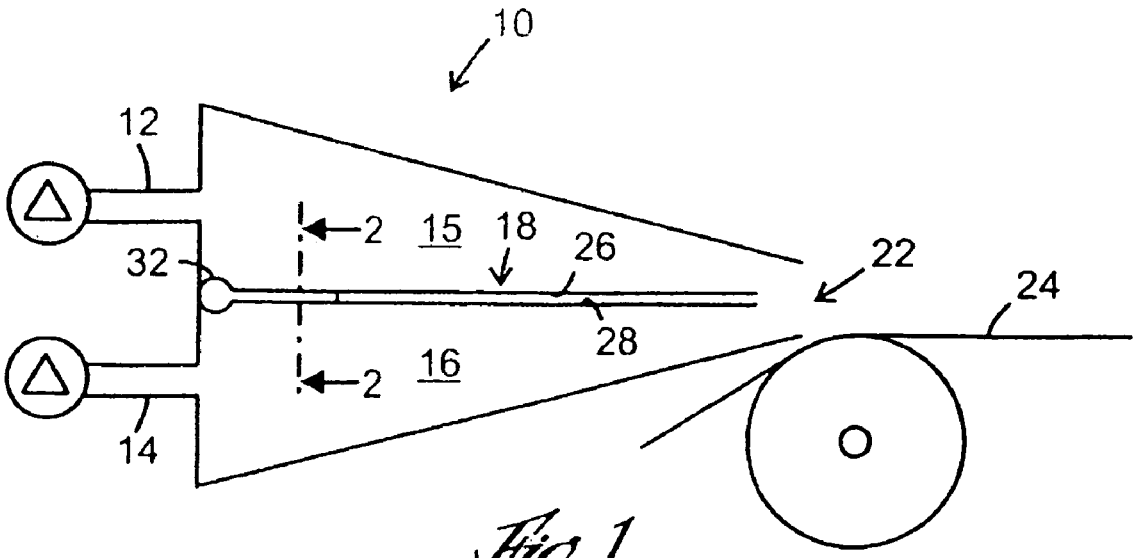
FIG. 1 shows a head box in accordance with the invention having a separating water dispensing blade device.
Figure 2:
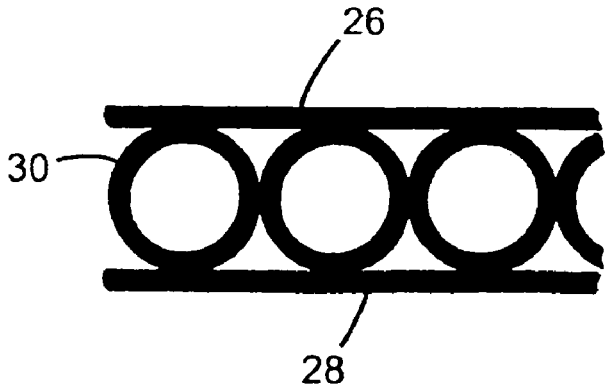
FIG. 2 shows a cross section of the blade device taken along the 2-2 line as shown in FIG. 1.
Figure 3:
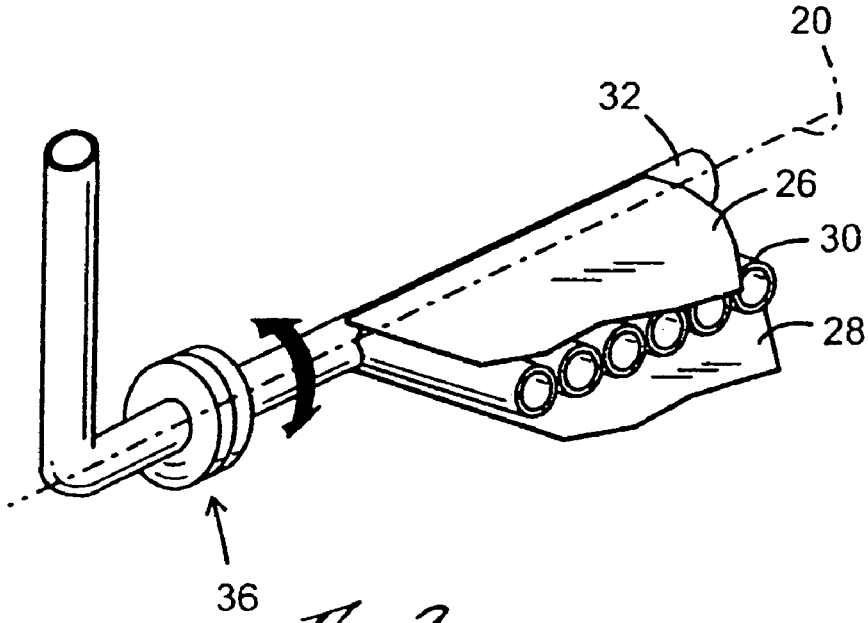
FIG. 3 shows a pivotally supported blade device.

FIG. 1 shows a cross section through a head box 10 for a paper machine. The head box 10 is supplied with two different streams of fiber suspension via inlet nozzles 12, 14 that feed the fiber suspension into ducts 15, 16, which are arranged above each other and separated by means of a substantially horizontal blade device 18. The fiber suspension is dispensed out from the head box 10 through an outlet 22 onto a paper forming wire 24, where the two layers of fiber suspensions are superposed to form a layered paper web. FIG. 2 shows a blade device 18 constituted by an upper sheet 26, a lower sheet 28 and internal channels in the form of parallel pipes 30 arranged between the upper and the lower sheet. The pipes 30 are arranged side-by-side and parallel to the flow direction of the fiber suspension. The sheets 26, 28, are arranged parallel and mutually spaced as shown in FIGS. 1 and 3. Water is pumped from an upstream end of the head box 10 by means of a pumping arrangement (not shown), whereby the internal channels have a pressure drop effect on the water flowing in the blade device (18). A uniform water layer is hereby formed downstream of the end of the blade device 18 forming an extension of the same. The water layer prevents or reduces the occurrence of a wake downstream the edge of the blade device 18. A wake would cause development of vortices in the fiber suspension layers and thereby give rise to unwanted mixing of the layers. The blade device 18 extends substantially from the up-stream end of the head box 10 to the outlet 22. The pipes 30 terminate at a distance from the outlet end of the blade device 18 as shown in FIG. 3, in order to achieve a uniform water flow out from the blade device 18.

Figure 4:
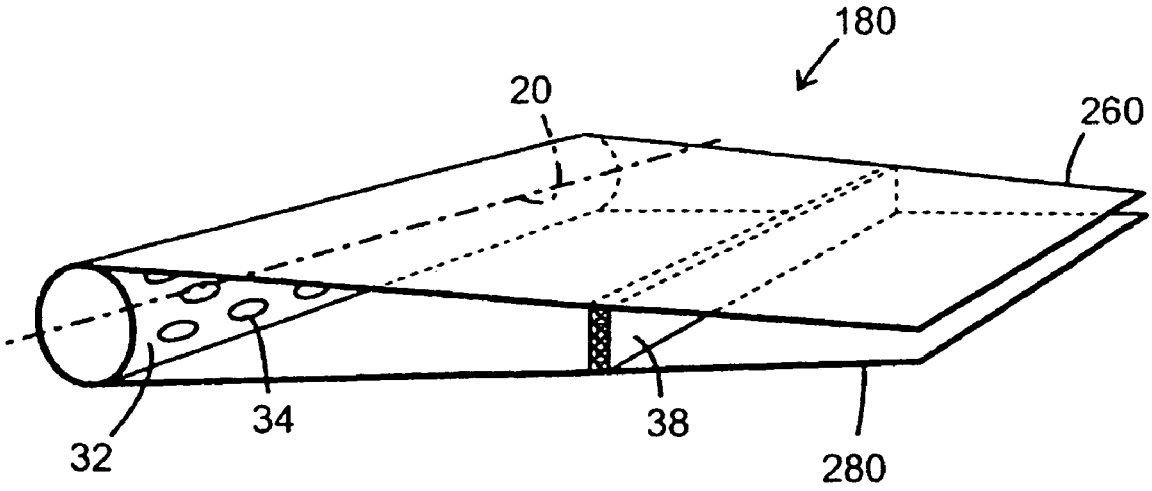
FIG. 4 shows an alternative embodiment of the blade device.

An alternative embodiment of the invention is shown in FIG. 4, wherein the blade device 180 comprises an upper sheet 260 and a lower sheet 280, which sheets converge towards each other in the direction of the intended water flow.

In another embodiment of the invention, the blade device 18, 180 is arranged without internal channels and is instead provided with one or more pressure drop screens 38 arranged inside the blade device 18, 180 transversely to the intended direction of the water flow as shown in FIG. 4. The pressure drop screen preferably comprises a porous material such as a net and is arranged to span the entire width and height of a cross section of the blade device 18, 180 in order to provide a uniform water flow out from the blade device 18, 180.

According to a preferred embodiment, the blade device 18, 180 is arranged to pivot freely around an axis 20, which is substantially perpendicular to the direction of the intended water flow. The blade device 18, 180 can be either rigid or elastically deformable. However, the height of the water outlet from the blade device 18, 180 and thereby the height of the water layer, is kept constant. In the embodiment comprising elastically deformable blade device, this can be achieved e.g. by using a rigid material for manufacturing the outlet part of the blade device 18, 180, while the rest of the blade device is manufactured from an elastically deformable material.

The water speed can be controlled by means of adjusting the pumping pressure of the water. A feed pipe 32, supplying water to the blade, is arranged in a position that coincides with the pivot axis 20. The feed pipe 32 is provided with openings 34 through which water is supplied to the blade device 18, 180. The blade device 18, 180 is attached to the feed pipe 32 in a rotationally fixed manner. The feed pipe 32 is rotationally arranged, preferably by means of a swivel connection 36 as shown in FIG. 3, so that the blade device 18, 180 can pivot freely.

According to an alternative embodiment, water can be fed to the blade device 18, 180 by means of a feed pipe having a single slotted, lengthwise aperture (not shown) through which water is supplied to the blade device 18, 180.

In another embodiment of the invention, the blade device 18, 180 is elastically deformable and has a non-pivotable mounting in the head box 10. The pressure equalization between the fiber suspension layers is hereby achieved only by deforming movements of the blade device 18, 180. A feed pipe 32, supplying water to the blade, is arranged at the upstream end of the blade device, perpendicular to the direction of the intended water flow and provided with openings 34 through which the water is supplied to the blade device 18, 180

Figure 5:
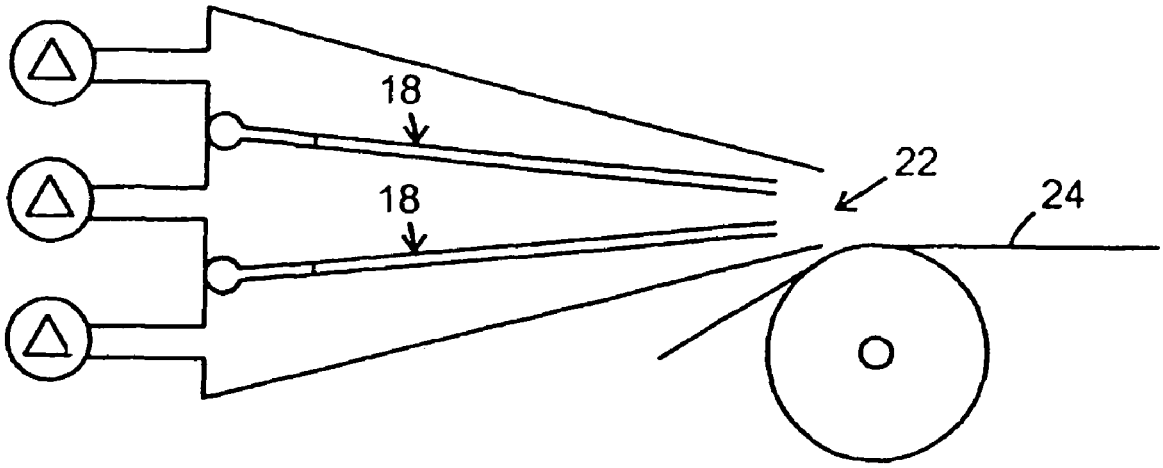
FIG. 5 shows a head box in accordance with the invention having two blade device.

The head box 10 can furthermore be provided with two or more blade device 18, 180, as shown in FIG. 5, whereby a multi-layered paper web is formed. Due to the self-adjustment of the blade device 18, 180 for pressure equalization layers, the vertical placement of the blade device 18, 180 in the head box 10 can be either symmetric or asymmetric.

The invention is not limited to the exemplified embodiments described above. A person skilled in the art will find further applications within the scope of the invention in the accompanying claims.

What is claimed is:

1. A method of forming a layered fibrous web comprising the steps of:

(a) leading at least two different fiber suspensions through a head box;

(b) arranging at least one blade device to separate the at least two fiber suspensions from each other and to be freely movable in a substantially vertical direction in order to permit an equalization of pressure between the at least two fiber suspension layers separated by the at least one blade device and thereby reducing wake effects downstream of an outlet end of the at least one blade device;

(c) forming at least one layer of water having a transversely uniform flow at the outlet end of the at least one blade device, such that the at least one layer of water constitutes an extension of the at least one blade device to separate and thereby prevent mixing of the at least two fiber suspensions; and (d) supplying the at least two fiber suspensions with the water therebetween to a web forming device.

2. The method according to claim 1, wherein the forming step includes pumping water through the at least one blade device in internal channels.

3. The method according to claim 2, wherein the internal channels terminate at a distance from the outlet end of the at least one blade device in order to provide a uniform flow rate of the water coming out from the at least one blade device.

4. The method according to claim 1, wherein the height of the outlet end of the at least one blade device is constant whereby the thickness of the at least one layer of water is constant and the transversely uniform flow has an adjustable flow rate by changing pumping pressure of the water.

5. The method according to claim 1, further including the step of supplying water to an upstream end of the at least one blade device by a feed pipe arranged perpendicular to a direction of intended water flow.

6. The method according to claim 1, further including the step of providing a pressure drop screen inside the at least one blade device transversely to a direction of water flow.

7. The method according to claim 1, wherein the arranging step includes arranging the at least one blade device to be movable in such a way that the at least one blade is elastically deformable, thereby permitting the equalization of pressure between the at least two fiber suspension layers.

8. The method according to claim 1, wherein the arranging step includes arranging the at least one blade device to be movable in such way that the at least one blade is pivotally supported at an upstream end thereof and can pivot freely around a pivot axis perpendicular to a flow direction of the water, thereby permitting the equalization of pressure between the at least two fiber suspension layers.

9. The method according to claim 8, wherein a feed pipe is connected to the at least one blade device in a rotationally fixed manner such that the feed pipe coincides with the pivot axis of the at least one blade device.

10. The method according to claim 1, wherein the transversely uniform flow of the at least one layer of water is adjustable with a speed independent of the speed of the at least two fiber suspension layers.

* * * * *

UNITED STATES PATENT AND TRADEMARK OFFICE

CERTIFICATE OF CORRECTION

PATENT NO. : 7,429,307 B2
APPLICATION NO. : 10/497419
DATED : September 30, 2008
INVENTOR(S) : Daniel Soderberg It is certified that error appears in the above-identified patent and that said Letters Patent is hereby corrected as shown below:

In Column 2, line 20, after "the", --different fiber suspension layers equal. This is-- should be inserted.

In Column 4, line 42, after "equalization", --between the fiber suspension-- should be inserted.

Signed and Sealed this

Twenty-third Day of December, 2008

JON W. DUDAS
*Director of the United States Patent and Trademark Office*